US005938504A

United States Patent [19]

Talieh

[11] Patent Number: 5,938,504

[45] Date of Patent: Aug. 17, 1999

[54] SUBSTRATE POLISHING APPARATUS

[75] Inventor: Homayoun Talieh, Cupertino, Calif.

[73] Assignee: Applied Materials, Inc., Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/460,938

[22] Filed: Jun. 3, 1995

Related U.S. Application Data

[63] Continuation of application No. 08/153,331, Nov. 16, 1993.

[51] Int. Cl.[6] ..... B24B 7/22

[52] U.S. Cl. ..... 451/11; 451/41; 451/173

[58] Field of Search ..... 451/41, 63, 59, 451/307, 304, 168, 173, 290, 289, 288, 287, 285, 5

[56] References Cited

U.S. PATENT DOCUMENTS

| | | | |
|---|---|---|---|
| 34,425 | 11/1862 | Schultz et al. . | |
| 619,399 | 2/1899 | Fischer | 45/163 |
| 3,156,073 | 11/1964 | Strasbaugh . | |
| 3,170,273 | 2/1965 | Walsh . | |
| 3,342,652 | 9/1967 | Reisman et al. . | |
| 3,447,306 | 6/1969 | Jakimcius | 45/544 |
| 3,654,739 | 4/1972 | Stoy et al. | 51/141 |
| 3,753,269 | 8/1973 | Budman | 45/444 |
| 3,812,622 | 5/1974 | Parsons | 451/444 |
| 3,841,031 | 10/1974 | Walsh . | |
| 3,906,678 | 9/1975 | Roth | 51/154 |
| 3,962,832 | 6/1976 | Strasbaugh . | |
| 3,986,433 | 10/1976 | Walsh et al. . | |
| 4,016,857 | 4/1977 | Hall | 125/21 |
| 4,128,968 | 12/1978 | Jones | 451/41 |
| 4,143,490 | 3/1979 | Wood . | |
| 4,239,567 | 12/1980 | Winings . | |
| 4,256,535 | 3/1981 | Banks . | |
| 4,257,194 | 3/1981 | Cailloux . | |
| 4,347,689 | 9/1982 | Hammond | 451/63 |
| 4,373,991 | 2/1983 | Banks . | |
| 4,380,412 | 4/1983 | Walsh . | |
| 4,416,090 | 11/1983 | Jonasson | 51/138 |
| 4,490,948 | 1/1985 | Hanstein et al. | 451/446 |
| 4,525,954 | 7/1985 | Larsen . | |
| 4,593,495 | 6/1986 | Kawakami et al. | 51/118 |
| 4,628,640 | 12/1986 | Johannsen | 51/141 |
| 4,642,943 | 2/1987 | Taylor, Jr. | 51/135 R |
| 4,653,231 | 3/1987 | Cronkhite et al. . | |
| 4,680,893 | 7/1987 | Cronkhite et al. . | |
| 4,704,823 | 11/1987 | Steinback | 51/110 |
| 4,811,522 | 3/1989 | Gill, Jr. | 51/314 |
| 4,839,993 | 6/1989 | Masuko et al. . | |
| 4,918,870 | 4/1990 | Torbert et al. . | |
| 4,934,102 | 6/1990 | Leach et al. | 51/50 R |
| 4,940,507 | 7/1990 | Harbarger . | |
| 4,941,293 | 7/1990 | Ekhoff | 451/63 |
| 4,944,836 | 7/1990 | Cote et al. . | |
| 4,956,944 | 9/1990 | Ando et al. | 451/5 |
| 4,964,242 | 10/1990 | Ruble et al. | 51/144 |
| 4,992,135 | 2/1991 | Doan . | |
| 4,993,190 | 2/1991 | Hiyoshi et al. | 451/307 |
| 5,020,283 | 6/1991 | Tuttle . | |
| 5,036,015 | 7/1991 | Sandhu et al. . | |
| 5,064,683 | 11/1991 | Poon et al. . | |
| 5,065,547 | 11/1991 | Shimizu et al. | 451/317 |
| 5,069,002 | 12/1991 | Sandhu et al. . | |
| 5,081,795 | 1/1992 | Tanaka et al. | 51/131.1 |
| 5,081,796 | 1/1992 | Schultz . | |
| 5,088,240 | 2/1992 | Ruble | 451/307 |
| 5,099,615 | 3/1992 | Ruble et al. | 51/165.71 |
| 5,113,622 | 5/1992 | Nishiguchi et al. . | |
| 5,114,875 | 5/1992 | Baker et al. . | |
| 5,169,491 | 12/1992 | Doan . | |
| 5,205,082 | 4/1993 | Shendon et al. . | |
| 5,209,027 | 5/1993 | Ishida et al. . | |
| 5,209,816 | 5/1993 | Yu et al. . | |
| 5,212,910 | 5/1993 | Breivogel et al. | 51/398 |
| 5,216,843 | 6/1993 | Breivogel et al. . | |
| 5,222,329 | 6/1993 | Yu . | |
| 5,225,034 | 7/1993 | Yu et al. . | |
| 5,230,184 | 7/1993 | Bukhman | 51/283 R |
| 5,232,875 | 8/1993 | Tuttle et al. . | |
| 5,234,867 | 8/1993 | Schultz et al. . | |
| 5,244,534 | 9/1993 | Yu et al. . | |
| 5,246,525 | 9/1993 | Sato | 156/345 |
| 5,274,964 | 1/1994 | Simpson et al. | 451/444 |
| 5,276,999 | 1/1994 | Bando | 51/62 |

| | | | |
|---|---|---|---|
| 5,287,663 | 2/1994 | Pierce et al. | 51/401 |
| 5,297,361 | 3/1994 | Baldy et al. | 51/119 |
| 5,297,364 | 3/1994 | Tuttle . | |
| 5,302,233 | 4/1994 | Kim et al. . | |
| 5,329,732 | 7/1994 | Karlsrud et al. . | |
| 5,329,734 | 7/1994 | Yu . | |
| 5,335,453 | 8/1994 | Baldy et al. | 51/67 |
| 5,399,125 | 3/1995 | Dozier | 474/117 |
| 5,456,627 | 10/1995 | Jackson et al. | 451/63 |
| 5,476,413 | 12/1995 | Hasegawa et al. | 451/168 |
| 5,487,697 | 1/1996 | Jensen | 451/324 |
| 5,490,808 | 2/1996 | Jantschek et al. | 451/59 |

FOREIGN PATENT DOCUMENTS

| | | | |
|---|---|---|---|
| 9001151 | 1/1984 | Japan | 451/307 |
| 2162466 | 7/1987 | Japan | 451/289 |

OTHER PUBLICATIONS

Olsen & Moghadan, Jun. 1992, Planarization Techniques, pp. 91–119.

Porter & Cable, 1990, Instruction Manual, Porter Cable Model 330 Finishing Sander.

*Primary Examiner*—Robert A. Rose

*Attorney, Agent, or Firm*—Fish & Richardson

[57] ABSTRACT

A chemical mechanical polishing apparatus includes a rotating plate on which a substrate is received, and a polishing pad which moves across the substrate as it rotates on the plate to polish the substrate. The load of the pad against the substrate, and the rotary speed of the plate, may be varied to control the rate of material removed by the pad.

35 Claims, 4 Drawing Sheets

SUBSTRATE POLISHING APPARATUS

This application is a Continuation of prior U.S. application Ser. No. 08/153,331, filed on Nov. 16, 1993.

BACKGROUND OF THE INVENTION

The present invention relates to the field of chemical mechanical polishing. More particularly, the present invention relates to methods and apparatus for chemical mechanical polishing of substrates used in the manufacture of integrated circuits.

Chemical mechanical polishing is a method of planarizing or polishing semiconductor and other types of substrates. At certain stages in the fabrication of devices on a substrate, it may become necessary to polish the surface of the substrate before further processing may be performed. One polishing process, which passes a conformable polishing pad over the surface of the substrate to perform the polishing, is commonly referred to as mechanical polishing. Mechanical polishing may also be performed with a chemically active abrasive slurry, which typically provides a higher material removal rate, and a higher chemical selectivity between films of the semiconductor substrate, than is possible with mechanical polishing. When a chemical slurry is used in combination with mechanical polishing, the process is commonly referred to as chemical mechanical polishing, or CMP.

One prior art CMP process is disclosed in U.S. Pat. No. 5,234,867, Schultz. That process generally includes the steps of rotating a polishing pad which has a diameter several times larger than a substrate, pouring a chemical slurry on the rotating polishing pad, and placing a substrate on the rotating polishing pad and independently rotating the substrate while maintaining pressure between the rotating polishing pad and the substrate. The polishing pad is held on a relatively massive planer platen which is coupled to a motor. The motor rotates the platen and polishing pad, and the platen provides a flat surface to support the rotating polishing pad. To independently rotate the substrate, it may be located within a separate rotating polishing head or carrier, which is also moveable in an x-y plane to locate the substrate rotating therein in specific positions on the large, rotating platen. As the polishing pad is several times larger than the substrate, the substrate may be moved from the outer diameter to the center of the rotating polishing pad during processing.

The rate of material removed from the substrate in CMP is dependent on several factors, including among others, the chemicals and abrasives used in the slurry, the surface pressure at the polishing pad/substrate interface, the net motion between the substrate and polishing pad at each point on the substrate. Generally, the higher the surface pressure, and net motion at the regions of the substrate which contact the polishing pad, the greater the rate of material removed from the substrate. In Schultz, '867, the removal rate across the substrate is controlled by providing an irregularly-shaped polishing pad, and rotating the substrate and polishing pad to attempt to create an equal "residence time" of the polishing pad against all areas of the substrate, and in one embodiment thereof, by also varying the pressure at the substrate/polishing pad interface. It should be appreciated that equipment capable of performing this process is relatively massive and difficult to control to the degree necessary to consistently remove an equal amount of material on all areas of the substrate.

Using a large rotating polishing pad for CMP processing has several additional processing limitations which lead to non-uniformities in the polished substrate. Because the entire substrate is rotated against the polishing pad, the entire surface of the substrate is polished to a high degree of flatness as measured across the diameter of the substrate. Where the substrate is warped, the portions of the substrate which project upwardly due to warpage tend to have higher material removal rates than the remainder of the substrate surface. Further, as the polishing pad polishes the substrate, material removed from the substrate forms particulates which may become trapped in the pad, and the polishing slurry dries on the pad. When the pad becomes filled with particulates and the slurry dries in the pad, the polishing surface of the pad glazes and its polishing characteristics change. Unless the user constantly monitors the removal rate of the polishing pad with each substrate, or group of substrates, and adjusts the slurry, load, position, and/or rotation speed of the polishing pad or substrate to maintain the desired material removal rate, the amount of material removed by the polishing pad from each substrate consecutively processed thereon will decrease.

SUMMARY OF THE INVENTION

The present invention provides methods and apparatus for polishing of substrates wherein the polishing pad is no larger than, and is preferably substantially smaller than, the radius of the substrate being polished. In a first preferred embodiment, the apparatus includes a rotating plate on which a substrate is held, and a polishing arm which is located adjacent the plate and is moved across the surface of the substrate as the substrate rotates on the rotating plate. The polishing arm includes a polishing pad on the end thereof, which is preferably variably loadable against the surface of the substrate as different areas of the substrate are polished thereby. The speed of rotation of the substrate may be varied, in conjunction with, or independently of, any adjustment in the load of the polishing pad against the substrate to control the rate of material removed by the polishing pad as it crosses the substrate.

In one alternative embodiment, the polishing arm is modified to receive a cartridge of polishing pad material, in tape form, a discrete length of which is exposed over the lower tip of the polishing arm to contact the substrate for polishing. The tape of polishing pad material may be moved over the polishing arm tip during processing to continuously provide a new polishing pad surface as the substrate is processed, or may be moved to provide a discrete new section of polishing pad tape to polish each new substrate.

In an additional alternative embodiment, the polishing pad may be offset from the polishing arm, and the polishing arm is rotated over the rotating substrate to cause the polishing pad to contact the rotating substrate as the polishing pad also rotates about the axis of the polishing arm.

BRIEF DESCRIPTION OF THE DRAWINGS

These, and other features of the invention will be apparent from the following description when read in conjunction with the accompanying drawings, wherein.

DESCRIPTION OF THE EMBODIMENTS

Figure 1:
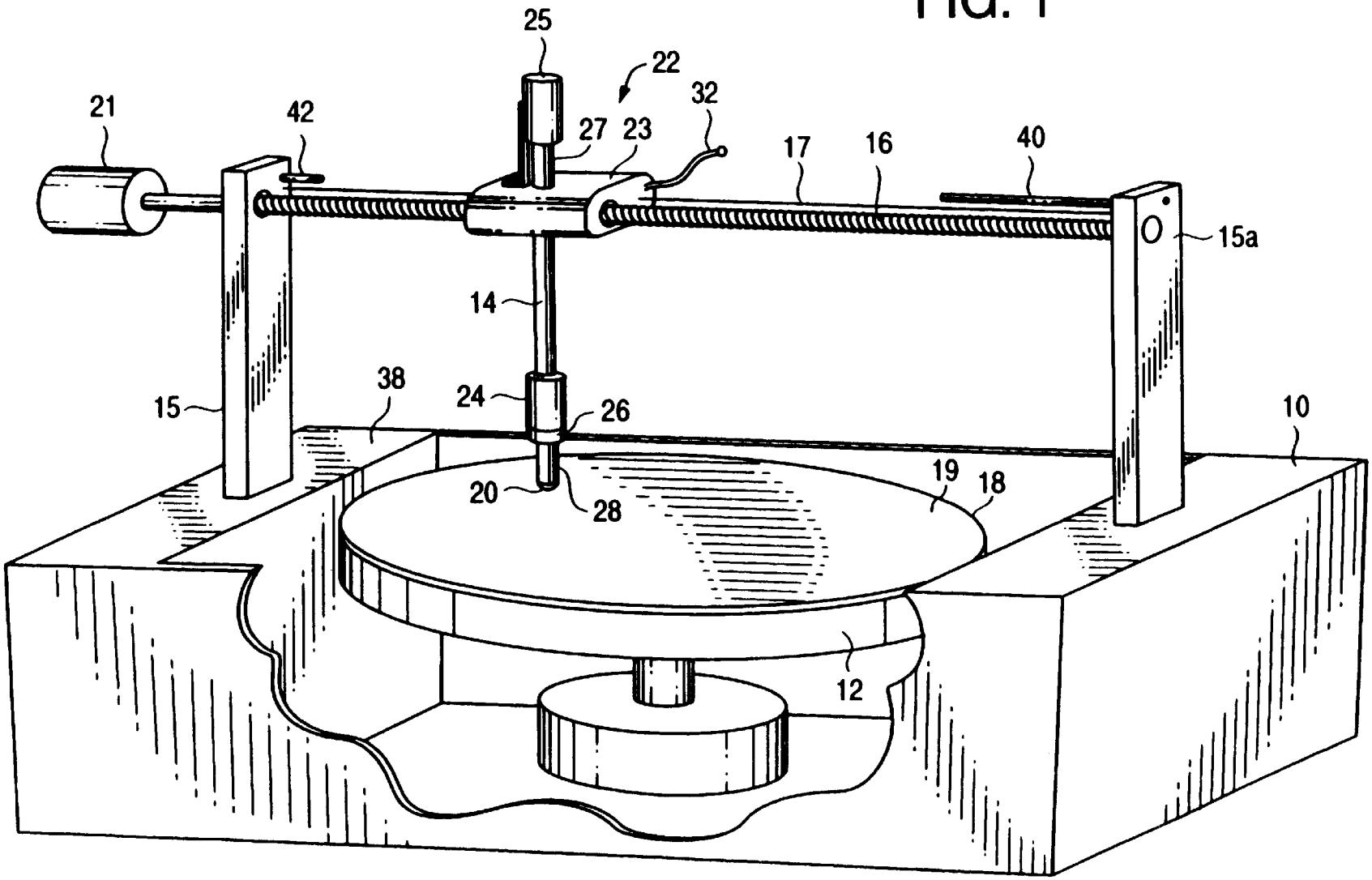
FIG. 1 is a perspective view, partially in cutaway, of the chemical mechanical polishing apparatus of the present invention.

Referring to FIG. 1, the chemical mechanical polishing apparatus of the present invention generally includes a base 10 for rotatably supporting a rotating plate 12 thereon, and a moveable tubular polishing arm 14 suspended over the rotating plate 12 and supported in position on a cross arm 16. Cross arm 16 is maintained on the base 10, and over the plate 12, by opposed uprights 15, 15*a* which extend upwardly from the base 10. The rotating plate 12 preferably includes a conformable pad 34 fixed to its upper surface. A substrate 18, having an upper surface 19 to be polished, is placed on the conformable pad 34 with its upper surface 19 exposed opposite the plate 12. The conformable pad 34 is wetted, so that surface tension will adhere the substrate 18 to the conformable pad 34 to maintain the substrate in position on the conformable pad 34 as the substrate 18 is polished. The tubular polishing arm 14, with a polishing pad 20 located over the lower open end 28 thereof, is moved generally radially across the upper surface 19 of the substrate 18 to perform the polishing. The polishing pad 20 is preferably continuously moved linearly across the rotating upper surface 19 of the substrate 18, from the edge to center thereof, until the polishing end point is reached. The polishing pad 20 is preferably five to fifty millimeters wide. Therefore, when a five, six, seven or eight inch (125–200 mm) substrate is located on the plate 12, the surface area of the polishing pad 20 is substantially smaller than the overall substrate area to be polished, generally at least three times smaller, and preferably at least 10 times smaller. The polishing pad 20 material is preferably a polyurethane impregnated polyester felt such as IC 1000, or Suba IV, both of which are available from Rodel, Inc. of Newark, Pa. To provide controllable substrate surface material removal rate across the entire substrate 18, the polishing arm 14 and cross arm 16 are provided with apparatus to control the positioning, and load, of the polishing arm 14 and polishing pad 20 with respect to substrate upper surface 19.

The positioning of the polishing arm 14, with respect to the substrate 18, is provided by a linear positioning mechanism 22 formed as an integral part of the cross arm 16. In one embodiment, as shown in FIG. 1, the linear positioning assembly 22 includes an internally-threaded slide member 23, and cross bar 16 includes mating threads to receive slide member 23 thereon. A secondary cross bar 17 is attached to uprights 15, 15*a* generally parallel to cross bar 16. Slide member 23 is received on cross bar 16, and the secondary cross bar 17 projects through slide member 23 to prevent its rotation with respect to cross bar 16. A stepper motor 21 is coupled to the cross bar 16 at upright 15 to rotate the cross bar 16 in discrete angular steps. In this configuration, the slide member 23, and polishing arm 14 with the polishing pad 20 attached to the lower open end 28 thereof, may be moved axially across the substrate 18 in increments as small as 0.01 mm by rotating the cross bar 16 in discrete small arcuate steps by stepper motor 21. Other drive means, such as a linear actuator, a geared tape pulley, or other precision positioning mechanism may be easily substituted for this polishing arm 14 drive system.

Referring still to FIG. 1, linear positioning assembly 22 precisely aligns the cross arm 16 over the substrate 18 to move the cross arm 16 from the edge to the center of the substrate 18. As the polishing pad 20 moves from the edge to the center of the substrate 18, the substrate 18 rotates on plate 12, and thus the polishing pad 20 contacts and polishes all areas of the substrate 18. To polish the center of the substrate 18 where the relative motion between the polishing pad 20 and the substrate 18 is at its minimum, the polishing arm may vibrate or rotate to create motion between the polishing pad 20 and the substrate 18 center.

To rotate the polishing arm 14, a servo motor 25 is coupled to slide member 23, and a drive shaft 27 extends from motor 25 into slide member 23 to engage the upper end of polishing arm 14. The upper end of polishing arm 14 is received in a rotary union at the base of slide member 23, which allows polishing arm 14 to rotate and also permits the transfer of liquids or gasses from slide member 23 into the hollow interior of the polishing arm 14. To provide vibratory motion, an offset weight may be coupled to the motor drive shaft 27. As the motor 25 rotates, this offset weight causes the motor 25, and thus slide member and polishing arm attached thereto, to vibrate.

To partially control the material removal rate of polishing pad 20, the load applied at the interface of the polishing pad 20 and substrate upper surface 19 is also variably maintained with a load mechanism 24 which is preferably an air cylinder, diaphragm or bellows. Load mechanism 24 and is preferably located integrally with polishing arm 14 between cross arm 16 and substrate 18. The load mechanism 24 provides a variable force to load the polishing pad 20 against the substrate 18, preferably on the order of 0.3 to 0.7 $Kg/cm^2$. A load cell 26, preferably a pressure transducer with an electric output, is provided integrally with polishing arm 14, and it detects the load applied by the polishing pad 20 on substrate upper surface 19. The output of the load cell 26 is preferably coupled to the load mechanism 24 to control the load of the polishing pad 20 on the substrate upper surface 19 as the polishing pad 20 actuates across the substrate 18.

To provide the slurry to the polishing pad 20, the slurry is preferably passed through the polishing arm 14 and out the open end 28 of polishing arm 14 to pass through the polishing pad 20 and onto the substrate. To supply slurry to the polishing arm, a slurry supply tube is connected to slide member 23, and passages within the slide member 23 direct the slurry from the supply tube 32 through the rotary union and into to the hollow interior of polishing arm 14. During polishing operations, a discrete quantity of chemical slurry, selected to provide polishing selectivity or polishing enhancement for the specific substrate upper surface 19 being polished, is injected through tube 32, slide member 23 and arm 14, to exit through polishing pad 20 to contact the substrate upper surface 19 at the location where polishing is occurring. Alternatively, the slurry may be metered to the center of the substrate 18, where it will flow radially out to the edge of the rotating substrate 18.

Figure 2:
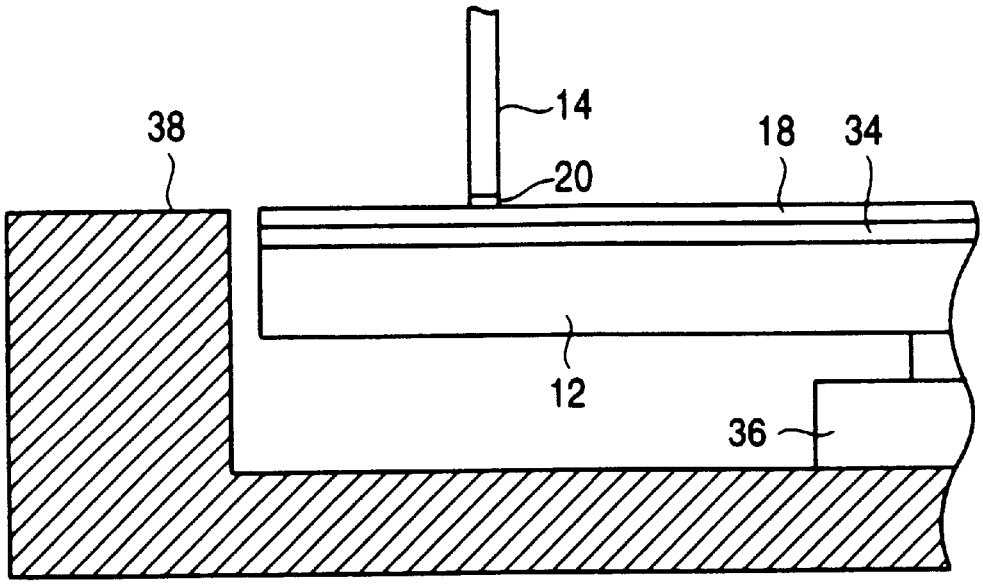
FIG. 2 is a partial side view of the chemical mechanical polishing apparatus of FIG. 1 with the side of the base removed.

Referring now to FIG. 2, to rotate the plate 12 and the substrate 18 located thereon, a motor 36 is coupled to the underside of the plate 12 with a drive shaft Motor 36 rotates the plate 12, and is preferably a variable speed direct current motor, such as a servo-motor, which may selectively provide variable substrate 18 rotation speeds during polishing operations.

Referring again to FIG. 1, to polish a substrate 18 with the CMP apparatus of the present invention, the substrate 18 is loaded onto pad 34, and the plate 12 is rotated to the proper polishing speed by the motor 36. The slide member 23 of the linear positioning mechanism 22 moves polishing arm 14 from a position beyond the substrate radial edge to a position adjacent the substrate edge to begin polishing the substrate upper surface 19. As the polishing arm 14 is moved to contact the substrate edge, the polishing pad 20 is passed over a reconditioning blade 38 maintained on base 10 to remove any particulates which may have collected in polishing pad 20 during previous polishing with the polishing pad 20. Blade 38 is preferably a sharp blade, and as polishing pad 20 is brought across it, the fibers of the pad are raised and particulates trapped therein are removed. Other reconditioning apparatus, such as diamond wheels or stainless wire brushes may also be used to recondition the polishing pad. Once polishing pad 20 is brought into contact with the outer edge of the substrate 18, chemical slurry is pumped through the tube 32 and out through polishing pad 20, and polishing arm 14 is rotated and/or vibrated. As the substrate 18 rotates under the polishing pad 20, slide member 23 moves the polishing arm 14 and polishing pad 20 from the substrate edge and across the substrate upper surface 19 to the center of the substrate 18. As the polishing pad 20 is moving, the load applied on substrate upper surface 19 by polishing pad 20 is controllably varied by load mechanism 24 to compensate for the decrease in net motion between the polishing pad 20 and substrate upper surface 19 which occurs as the polishing pad 20 approaches the center of the substrate 18. Further, the speed of rotation of plate 12, and thus the net motion between polishing pad 20 and the substrate 18, may be varied in conjunction with, or independently of, the relative radial position of polishing pad 20 on substrate 18 by varying the motor 36 speed. Once the polishing end point is reached, the chemical slurry stops flowing, the rotation and/or vibration stops, and the slide member 23 moves polishing arm 14 across reconditioning blade 38 and back to its original position adjacent the upright 15. To properly position polishing arm 14 for the next substrate 18 to be polished, a zero position stop 42 extends from upright 15, generally parallel to cross arm 16, and slide member 23 stops moving when it engages zero position stop 42. When the next substrate 18 is positioned on the plate 12, and the next polishing cycle begins, the polishing pad 20 will again cross the reconditioning blade 38 to raise fibers in the polishing pad 20 and remove particulates which may have collected in polishing pad 20 as a result of accumulated substrate polishing. Alternatively, the polishing pad 20 may be replaced after each polishing cycle.

Figure 3:
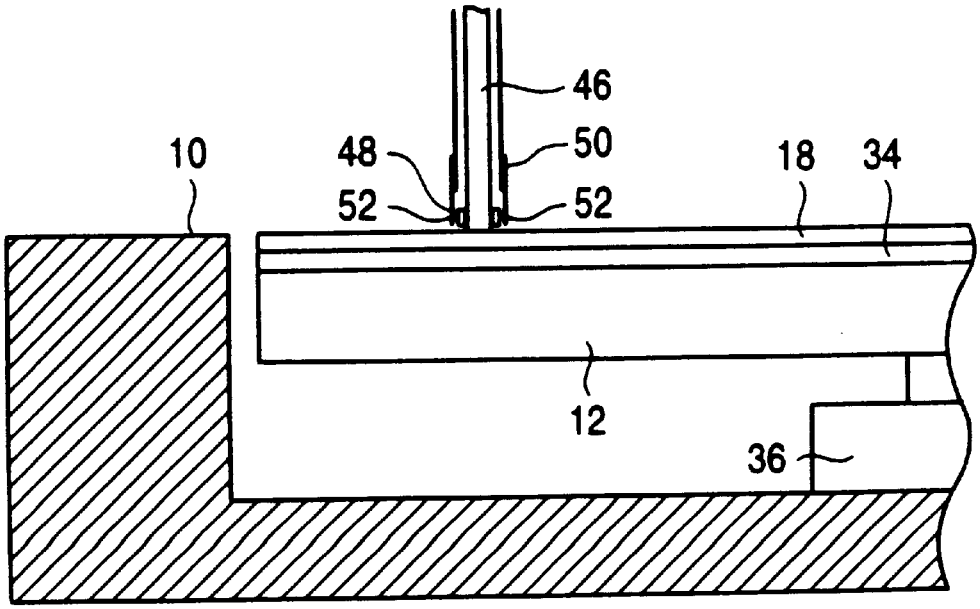
FIG. 3 is a partial side view of an alternative embodiment of the polishing apparatus of the chemical mechanical polishing apparatus of FIG. 2.
Figure 4:
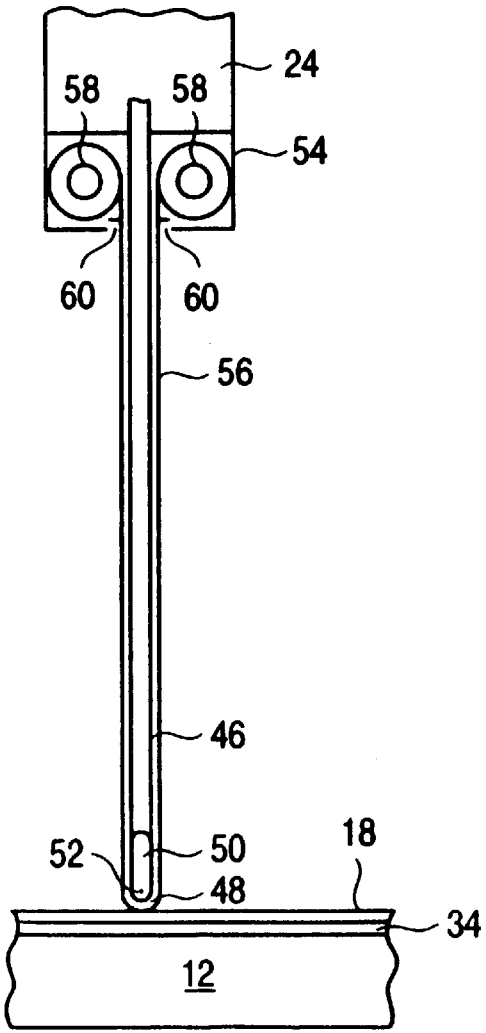
FIG. 4 is a side view of the polishing arm of the alternative embodiment of the chemical mechanical polishing apparatus of FIG. 3.

FIGS. 3 and 4 show a second preferred embodiment of the polishing arm 14 useful with the chemical mechanical polishing apparatus of the present invention. In this embodiment, the polishing arm 14 includes a tubular roller support arm 46 which extends downwardly from the load member 24, and a roller member 48 which is attached to the lower terminus of roller support arm 46 by bearing plates 50. The plates 50 are located on opposite sides of the roller support arm 46 and extend downwardly therefrom to receive rotatable roller axle 52 extending from either end of the roller member 48. The roller member 48 preferably freewheels within the plates 50, although it may be coupled to a drive system to be positively rotated. To provide the polishing pad surface to polish the substrate 18, a cassette 54 is loaded on the upper end of the roller support arm 46 and a tape 56 of polishing pad material is looped over the roller 48 such that the ends thereof are wound between spools 58 in the cassette 54. The tape 56 of polishing material is preferably aligned on the substrate by aligning the axles 52 parallel to the radius of the substrate 18. The cassette 54 preferably includes an integral drive motor which rotates the spools 58 to provide a clean polishing pad surface at roller 48 as required. It also optionally includes a pair of reconditioning blades 60 which contact the polishing tape 56 surface to clean it of particulates which accumulate therein from substrate polishing. The tape 56 may be incrementally moved, to provide a clean polishing pad surface on roller 48 after each polishing cycle, or may be continuously or incrementally moved to provide a fresh, clean polishing pad surface at the polishing pad/substrate interface while each individual substrate 18 is being polished. To provide the fresh polishing pad material against the substrate 18, the roller 48 may alternatively be positively driven by a drive mechanism to move the tape 56 over the roller 48 and the substrate upper surface 19, and the reconditioning blade may be located adjacent roller 48. Polishing slurry may be provided, in metered fashion, through the hollow interior of the roller support arm 46 to supply the polishing slurry directly at the polishing pad/substrate interface.

Figure 5:
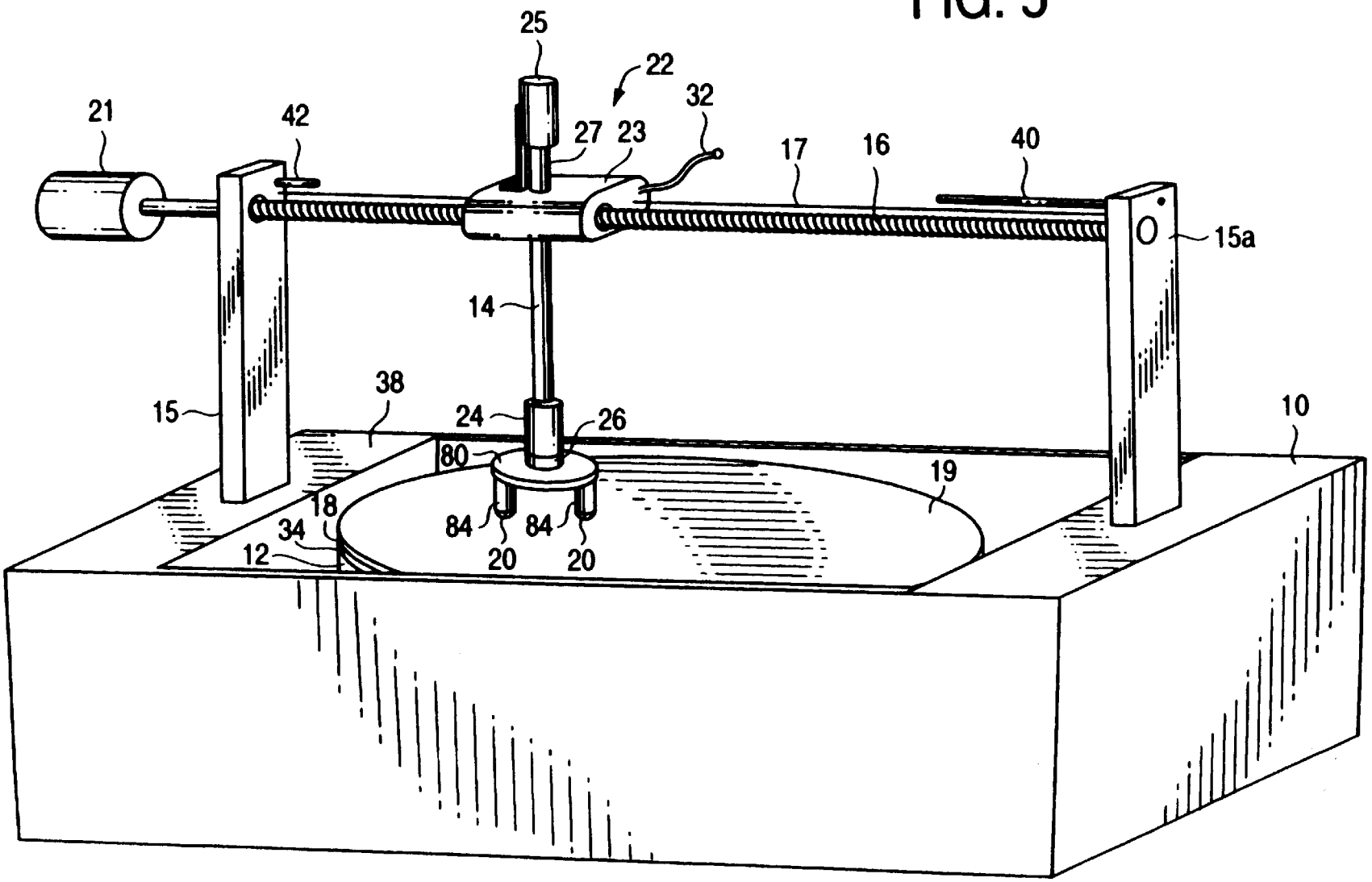
FIG. 5 is a perspective view of a further alternative embodiment of the chemical mechanical polishing apparatus of the present invention.

Referring now to FIG. 5, an additional alternative embodiment of the invention is shown. In this embodiment, polishing arm 14 extends downwardly from load mechanism 24 and terminates on secondary plate 80 located above, and generally parallel to, the rotating plate 12. A pair of secondary polishing arms 84, each having a polishing pad 20 on the end thereof, extend downwardly from intermediate plate 80 to position the polishing pads 20 in position to engage the substrate upper surface 19. Secondary polishing arms 84 are preferably located adjacent the edge of intermediate plate 80, 180 degrees apart, and polishing arm 14 is preferably connected to the center of secondary plate 80. Thus, as polishing arm 14 is rotated by motor 25, secondary polishing arms 84 traverse a circular path having a mean diameter equal to the linear distance between the centers of secondary polishing arms 84. As linear positioning assembly 22 moves polishing arm 14 over the substrate 18, and the secondary polishing arms 84 rotate about the longitudinal axis of the polishing arm 14, net movement will occur between the pads 20 and all areas of the substrate upper surface 19.

To ensure even net relative motion between the polishing pads 20 and the substrate upper surface 19, the length of the span between the secondary polishing arms 84 on intermediate plate 80, in combination with the length of travel of the slide member to position the pads 20 from the edge to center of the substrate, should not exceed the radius of the substrate, and the rate in rpm, and direction, of rotation of both plate 12 and polishing arm 14 must be equal. Preferably, the span between the centers of the two polishing pads 20 on the ends of secondary polishing arms 84 is 3 to 4 cm. Additionally, although two secondary polishing arms 84 are shown, one, or more than two, polishing arms, or an annular ring of polishing pad material may be connected to the underside of the intermediate plate 80 without deviating from the scope of the invention.

Figure 6:
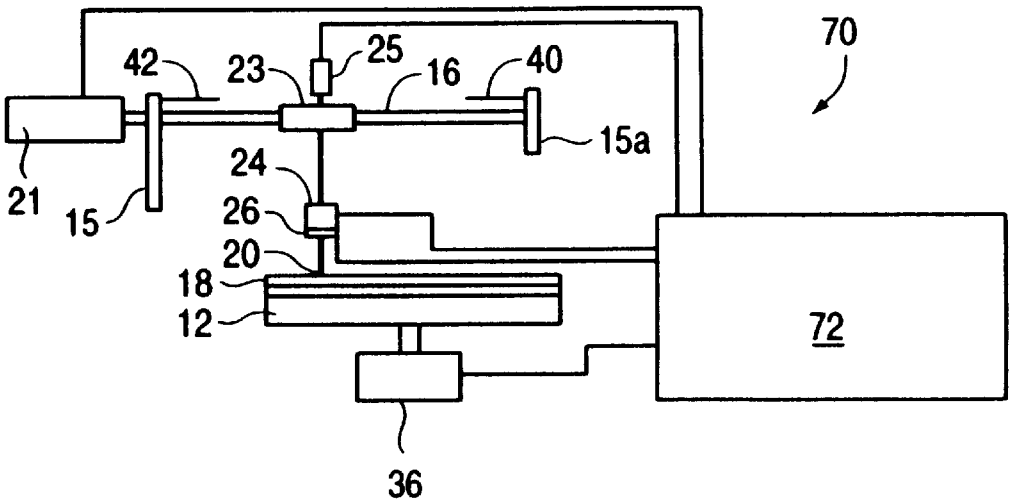
FIG. 6 is a schematic view of the control system used with the chemical mechanical polishing apparatus of the present invention.

Referring now to FIG. 6, a schematic of the control system 70 for controlling the chemical mechanical polishing apparatus of the present invention is shown The control system 70 includes a controller 72 which is coupled, by electrical cables, to load mechanism 24, load cell 26, plate drive motor 36, cross bar stepper motor 21 and motor 25. When the chemical mechanical polishing apparatus is first used, the controller 72 signals the stepper motor 21 of the linear positioning mechanism 22 to rotate the threaded cross bar 16, and thus move the slide member 23 and polishing arm 14 attached thereto to the fully-retracted position adjacent upright 15. As slide member 23 positions the polishing arm 14 in the fully-retracted position, a signal member thereon, preferably a signal pin, touches the zero position stop 42 which sends a signal to the controller 72 indicating that the polishing arm 14 is in the fully retracted position. Controller 72 then actuates the stepper motor 21 to move polishing arm 14 to the edge of substrate upper surface 19. As polishing pad 20 is moving into position to engage the edge of substrate 18, the controller 72 starts motor 36 to rotate substrate 18 at the desired speed.

Once polishing pad 20 engages the edge of substrate 18, the controller 72 further signals the load member 24 to create a bias force, or load, at the interface of the polishing pad 20 and the substrate upper surface 19, signals motor 25 to vibrate and/or rotate polishing arm 14, and simultaneously starts the flow of the polishing slurry into polishing pad 20. The controller 72 monitors and selectively varies the location, duration, pressure and linear and rotational relative velocity of the polishing pad 20 at each radial location on the substrate upper surface 19 through the linear position mechanism 22, load member 24, motor 25 and motor 36 until the polishing end point is detected. An end point detector, such as an ellipsometer capable of determining the depth of polishing at any location on the substrate 18, is coupled to the controller 72. The controller 72 may stop the movement of the linear position apparatus 22 in response to end point detection at a specific substrate radius being polished, or may cycle the linear position apparatus 22 to move polishing pad 20 back and forth over the substrate 18 until the polishing end point is reached and detected at multiple points on substrate upper surface 19. In the event of a system breakdown, a stop 40 projects from upright 15*a* generally parallel to cross bar 16 to prevent slide member 23 from travelling completely over the substrate 18. Once the polishing end point is reached, the controller 72 signals the load cell to lift polishing arm 14 off the substrate 18, stop delivery of the polishing slurry, and move slide member 23 back into engagement with zero position stop 42. The polished substrate 18 is then removed, and a new substrate 18 may be placed on plate 12 for polishing.

As herein described, the chemical mechanical polishing apparatus of the present invention provides a compact processing station which uses minimal consumables to provide a polished substrate. By providing the chemical agent in metered amounts through the polishing pad 20, or on the portion of polishing tape 56 adjacent roller 48, a minimal amount of chemical slurry is needed to polish the substrate 18, and substantially less chemical is wasted as compared to prior art apparatus in which only a portion of the slurry reaches the polishing pad/substrate interface. Also, because the entire surface of the polishing pad 20 is maintained against the substrate upper surface 19 during most of the period of time when slurry is being pumped therethrough, the slurry should not dry as quickly in the polishing pad 20 and thus the resulting variation in polishing characteristics which occurs when slurry dries in the large polishing pad should be substantially delayed. Additionally, the polishing pad 20 of the present invention may be cleaned in place on the end of polishing arm 14 by passing the polishing pad 20 over a reconditioning blade 38 or other reconditioning member, without the need to shut down the apparatus as is required in the prior art large polishing pad machines. As a result, substantially less polishing pad material need be used to polish a substrate 18, and the polishing apparatus may be used for longer periods of time between equipment shutdowns. Further, the present invention can provide equal polishing over an entire substrate to a much finer precision than that found in the prior art. By providing a relatively small polishing pad, as compared to the sized of the rotating polished object, the amount of material removed at each location on the substrate may be finely controlled in the specific small area under the polishing pad 20. Additionally, the polishing pad 20 may be controlled to follow the warped contour of a substrate 18, and thus substantially equalize the amount of material removed from upper substrate surface 19 irrespective of the existence of raised areas created by warpage of substrate 18.

Although specific preferred embodiments of the invention have been described, it should be appreciated by those skilled in the art that modifications to these specific embodiments may be made without deviating from the scope of the invention. For example, although a polishing pad 20 on the order of five to fifty mm has been described, the size of the polishing pad 20 may be varied up to the radius of the substrate being polished, without detracting from the advantages of the present invention.

I claim:

1. A method of chemical mechanical polishing a substrate, comprising the steps of:

locating a substrate of the type on which a circuit is fabricated on a member;

rotating the member to rotate the substrate at a selected rotational speed;

withdrawing a polishing tape from a cassette so as to provide a fresh length of a polishing pad material;

positioning the polishing pad material in contact with a surface of the substrate across a contact area less than the total surface area of the substrate as the substrate rotates;

supplying a chemically reactive liquid to the contact area;

moving the polishing pad material relative to the surface of the rotating substrate to chemical mechanical polish the substrates;

applying a force to bias the polishing pad material against the surface of the substrate; and varying at least one of the bias force and the rotational speed of the substrate as the polishing pad material moves across the substrate.

2. A method of chemical mechanical polishing a substrate, comprising the steps of:

locating a substrate of the type on which a circuit is fabricated on a member;

rotating the member to rotate the substrate;

withdrawing a polishing tape from a cassette so as to provide a polishing surface;

positioning the polishing surface in contact with the substrate across a contact area less than the total surface area of the substrate as the substrate rotates;

supplying a chemically reactive liquid to the contact area;

moving the polishing pad relative to the rotating substrate to chemical mechanical polish the substrate; and reconditioning the polishing surface before positioning it on the substrate.

3. The method of claim 1, wherein the step of withdrawing the polishing tape is performed as the substrate is polished.

4. The method of claim 3, further including the step of reconditioning the polishing tape as it is moved over the substrate.

5. The method of claim 3, wherein the step of withdrawing the polishing tape is performed incrementally.

6. The method of claim 3, wherein the step of withdrawing the polishing tape is performed continuously.

7. The method of claim 1, wherein the contact area is at least one order of magnitude smaller than the total surface area of the substrate.

8. The method of claim 1, wherein the chemically reactive liquid is supplied to the contact area through a polishing arm.

9. The method of claim 1, further comprising the step of pressing the polishing pad against the contact area with a pressure of approximately 0.3 to 0.7 $Kg/cm^2$.

10. An apparatus for chemical mechanical polishing of a substrate, comprising:

a rotatable plate for receiving and rotating a substrate of the type on which a circuit is fabricated;

a polishing arm laterally movable parallel to a surface of the substrate, said polishing arm including a roller on a lower end thereof;

a length of polishing pad material extending over the roller to form a polishing pad, said polishing pad selectively engageable with the substrate when the substrate is received on the plate, the polishing pad contacting the substrate in a contact area less than the total surface area of the substrate to chemical mechanical polish the surface thereof; and a slurry supply to provide a chemically reactive liquid to the contact area.

11. The polishing apparatus of claim 10, wherein said polishing arm includes a variable load member thereon.

12. The polishing apparatus of claim 10, further including a variable speed motor coupled to said rotatable plate.

13. The polishing apparatus of claim 10, further including a process controller interconnected to, and controlling, said variable load member and said variable speed motor.

14. The polishing apparatus of claim 10, wherein said length of polishing pad material is received in a cassette.

15. The polishing apparatus of claim 10, further including means for moving said length of polishing pad material over said roller.

16. An apparatus for chemical mechanical polishing a surface of a substrate, comprising:

a support for receiving a substrate of the type on which a circuit is fabricated;

a length of polishing material extendable from a first position to a second position, wherein at least a portion of the polishing material which extends between said first position and said second position contacts a substrate surface in a contact area to chemical mechanical polish the substrate;

a slurry supply to provide a chemically reactive liquid to the contact area; and a drive member for moving the polishing material from said first position to said second position.

17. The apparatus of claim 16, wherein said first position includes a driven spool coupled to said drive member.

18. The apparatus of claim 17, wherein said second position includes a second spool, and said polishing material passes from said second spool to said driven spool.

19. The apparatus of claim 18, wherein said drive member is an electric motor.

20. The apparatus of claim 18, further including a roller disposed intermediate said driven spool and said second spool and a positioning member to position said roller to bias said polishing material extending between said driven spool and said second spool into contact with the substrate surface.

21. The apparatus of claim 20, wherein said positioning member extends from a cross arm positioned over the substrate surface.

22. An apparatus for chemical mechanical polishing a surface of a substrate, comprising:

a support for receiving a substrate of the type on which a circuit is fabricated;

a length of polishing material extendable from a first position to a second position, wherein at least a portion of the polishing material which extends between said first position and said second position contacts a substrate surface in a contact area to chemical mechanical polish the substrate;

a slurry supply to provide a chemically reactive liquid to the contact area; and a drive member for moving the polishing material from said first position to said second position;

wherein said drive member continuously moves the polishing material between said first position and said second position during polishing.

23. An apparatus for chemical mechanical polishing a surface of a substrate, comprising:

a support for receiving a substrate of the type on which a circuit is fabricated;

a length of polishing material extendable from a first position to a second position, wherein at least a portion of the polishing material which extends between said first position and said second position contacts a substrate surface in a contact area to chemical mechanical polish the substrate;

a slurry supply to provide a chemically reactive liquid to the contact area; and a drive member for moving the polishing material from said first position to said second position;

wherein said drive member intermittently moves the polishing material between said first position and said second position during polishing.

24. The apparatus of claim 16, wherein said drive member moves the polishing material between said first position and said second position after at least one substrate has been polished.

25. The apparatus of claim 16, wherein said polishing material rotates about an axis substantially perpendicular to the substrate surface.

26. The apparatus of claim 16, wherein the polishing material is a tape of material having a width which is no greater than a radius of the substrate.

27. A method of chemical mechanical polishing a surface of a substrate, comprising the steps of:

providing a length of polishing material;

moving at least a portion of the polishing material from a first position to a second position;

contacting at least a portion of the polishing material passing from the first position to the second position with a surface of a substrate of the type on which a circuit is fabricated; and supplying a chemically reactive liquid to the substrate to chemical mechanical polish the substrate.

28. The method of claim 27, including the further step of continuously moving the polishing material from the first position to the second position while at least a portion of the polishing material extending between the first position and the second position is in contact with the surface of the substrate.

29. The method of claim 28, including the further step of rotating the polishing material in contact with the substrate about an axis substantially perpendicular to the surface of the substrate.

30. A method of chemical mechanical polishing a surface of a substrate, comprising the steps of:

providing a length of polishing material;

moving at least a portion of the polishing material from a first position to a second position;

contacting at least a portion of the polishing material passing from the first position to the second position with a surface of a substrate of the type on which a circuit is fabricated;

supplying a chemically reactive liquid to the substrate to chemical mechanical polish the substrate; and incrementally moving the polishing material from the first position to the second position while at least a portion of the polishing material extending between the first position and the second position is in contact with the surface of the substrate.

31. The method of claim 30, including the further step of rotating the polishing material in contact with the substrate about an axis substantially perpendicular to the surface of the substrate.

32. The method of claim 27, including the further steps of:

providing a biasing member between the first position and the second position; and biasing the polishing material against the surface of the substrate with the biasing member.

33. The method of claim 27, further comprising the step of pressing the polishing material against the substrate with a pressure of approximately 0.3 to 0.7 $Kg/cm^2$.

34. An apparatus for chemical mechanical polishing the surface of a substrate, comprising:

a support for receiving a substrate of the type on which a circuit is fabricated;

a length of polishing material extendable from a first position to a second position, wherein at least a portion of the polishing material extending between said first position and said second position contacts a surface of the substrate in a contact area to chemical mechanical polish the substrate;

a slurry supply to provide a chemically reactive liquid to the contact area; and a drive member for moving the length of polishing material from said first position to said second position.

35. A method of chemical mechanical polishing the surface of a substrate, comprising the steps of:

providing a length of polishing material;

bringing at least a portion of the polishing material into contact with a surface of a substrate of the type on which a circuit is fabricated;

supplying a chemically reactive liquid to the substrate;

moving the portion of the polishing material relative to the substrate to chemical mechanical polish the substrate; and moving the portion of the polishing material from a first position to a second position.

* * * * *